US006837948B2

(12) United States Patent
Kondo et al.

(10) Patent No.: US 6,837,948 B2
(45) Date of Patent: Jan. 4, 2005

(54) PROCESS OF PRODUCTION OF COMPRESSOR SHOE

(75) Inventors: Yoshitami Kondo, Kariya (JP); Masanobu Tomita, Kariya (JP); Yasuhiro Miura, Kariya (JP); Hironobu Tsushima, Kariya (JP); Suguru Hirota, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/160,849

(22) Filed: May 31, 2002

(65) Prior Publication Data

US 2002/0189717 A1 Dec. 19, 2002

(30) Foreign Application Priority Data

Jun. 18, 2001 (JP) ..... 2001-183113

(51) Int. Cl.[7] ..... C21D 9/00; C21D 6/00

(52) U.S. Cl. ..... 148/637; 148/633; 148/628; 148/625; 148/660

(58) Field of Search ..... 148/637, 633, 148/628, 625, 660, 662

(56) References Cited

U.S. PATENT DOCUMENTS

| | | | | |
|---|---|---|---|---|
| 4,512,175 | A | 4/1985 | Kaku et al. | 72/360 |
| 4,683,804 | A | 8/1987 | Futamura et al. | 92/71 |
| 5,082,512 | A | 1/1992 | Futamura et al. | 148/330 |

FOREIGN PATENT DOCUMENTS

| | | |
|---|---|---|
| JP | 11-132143 | 5/1999 |

OTHER PUBLICATIONS

English abstract of Japanese patent 54075402, dated Jun. 16, 1979.*

EP 02 01 2681 Search Report dated Oct. 8, 2003.

* cited by examiner

*Primary Examiner*—Deborah Yee
(74) *Attorney, Agent, or Firm*—Woodcock Washburn LLP

(57) ABSTRACT

A process of production of a compressor shoe superior in durability and reduced in manufacturing cost, wherein a process of quenching the shoe is performed in a vacuum, inert gas, or modified gas so as to prevent oxidation of the chrome and manganese of the surface of the material or the quenching process is performed after forming an antioxidation film on the surface of the material to prevent the oxidation of the chrome and manganese.

3 Claims, 7 Drawing Sheets

4.0μm 4.0μm 6.5μm

PROCESS OF PRODUCTION OF COMPRESSOR SHOE

BACKGROUND OF THE INVENTION

1. Field of the Invention

The present invention relates to a process of production of a compressor shoe.

2. Description of the Related Art

The refrigeration circuit used in a car air-conditioner includes a compressor for compressing refrigerant gas. For example, in a known variable displacement swash plate type compressor, as shown in FIG. 7, a cylinder block 91 is formed with a plurality of cylinder bores 91*a*. Pistons 92 are accommodated in these cylinder bores 91*a* to be able to reciprocate in them. Further, a swash plate 93 able to synchronously rotate and be inclined is supported by a not shown rotatably supported drive shaft. Between the swash plate 93 and each piston 92 is provided a pair of shoes 94 sandwiching the swash plate 93. Each shoe 94, as illustrated in FIG. 8, has a top surface forming part of a spherical surface as a spherical part 94*a* and bottom surface forming a substantially flat surface as the flat part 94*b*. A cylindrical part 94*c* is formed through rounded portion.

In a compressor configured in the above way, due to the rotation of the drive shaft, as shown in FIG. 7, the swash plate 93 synchronously rotates and inclines to cause the pistons 92 via the shoe 94 to reciprocate inside the cylinder bores 91*a*. Due to this, refrigerant gas is sucked in, compressed, and discharged at the head sides of the pistons 92. The spherical parts 94*a* of the shoes 94 slide with the surfaces of the spherical seats 92*a* of the pistons 92, while the flat parts 94*b* slide with the surface of the swash plate 93. Therefore, the shoes 94 are subjected to a large frictional force between the pistons 92 and the swash plate 93, so the shoes 94 are required to have abrasion resistance and a long fatigue life.

In the past, such a shoe 94 was manufactured by the following method (shown in FIG. 1). That is, first, a blank ball 80 was fabricated from the high carbon chrome bearing steel SUJ2 (JIS G4805).

Here, SUJ2 is comprised of the following:

Carbon: 0.95 to 1.10 wt %

Chrome: 1.30 to 1.60 wt %

Manganese: 0.5 wt % or less

Silicon: 0.15 to 0.35 wt %

Phosphorus: 0.025 wt % or less

Sulfur: 0.025 wt % or less

Further, the blank ball 80 is obtained by cutting out an amount of material enabling formation of a shoe from a rod member comprised of the above SUJ2, forming this material into a spherical shape, then quenching, tempering, polishing, and annealing it.

Next, as shown in FIG. 1, the blank ball 80 is formed into a material 81 of a shoe shape by a press process S71. Next, the material 81 is subjected to a quenching process S72 in a quenching furnace to obtain a quenched shoe 82 given a high hardness. Further, the quenched shoe 82 is subjected to a tempering process S73 in a tempering furnace to obtain a heat treated shoe 83 maintaining its high hardness and given toughness. Finally, a polishing process S74 is applied to the heat treated shoe 83 to obtain the compressor shoe 94.

The thus manufactured shoe 94 is given a high hardness by the application of the quenching process S72 to the material 81 and is given a high toughness by the application of the subsequent tempering process S73, so the required abrasion resistance and long fatigue life are realized.

In a shoe manufactured by the above process of production of the related art, if the heat treated shoe 83 is not sufficiently polished, the durability becomes insufficient, so a long time is required for the polishing process S74 and the costs of manufacture end up skyrocketing.

SUMMARY OF THE INVENTION

An object of the present invention is to provide a process for the production of a compressor shoe superior in durability and reduced in manufacturing cost.

According to the present invention, there is provided a process of production of a compressor shoe including a process of quenching a material in a quenching furnace comprised of chrome and/or manganese steel and forming a shoe shape, said quenching process comprising a step of preventing oxidation of the chrome and/or manganese.

Preferably, the step is lowering a pressure in the quenching furnace to create a vacuum.

Alternatively, the step is replacing in atmosphere of the quenching furnace by an inert gas or modified gas.

Preferably, the step is forming an antioxidation film able to prevent oxidation of the chrome and/or manganese on the surface of the material before quenching.

More preferably, the antioxidation film is a phosphate film.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

The inventors engaged in intensive research to solve the above problems, and after the following considerations, perfected the present invention.

That is, when the polishing process S74 is insufficient, the surface of the shoe 94 flakes off to form abraded dust during operation of the compressor. This abraded dust abrades the spherical seat 92*a* of the piston 92 in a sliding relationship with the shoe 94 and increases the shoe clearance between the shoe 94 and the spherical seat 92*a*. As a result, the performance of the compressor is liable to become insufficient. In particular, in a variable volume swash plate type compressor using a piston using only one side as a head, there is a great problem due to the increase in the shoe clearance.

According to tests of the inventors, it was learned that this problem was due to the oxidation of the chrome and manganese added to SUJ2 at the quenching process S72.

Figure 6:
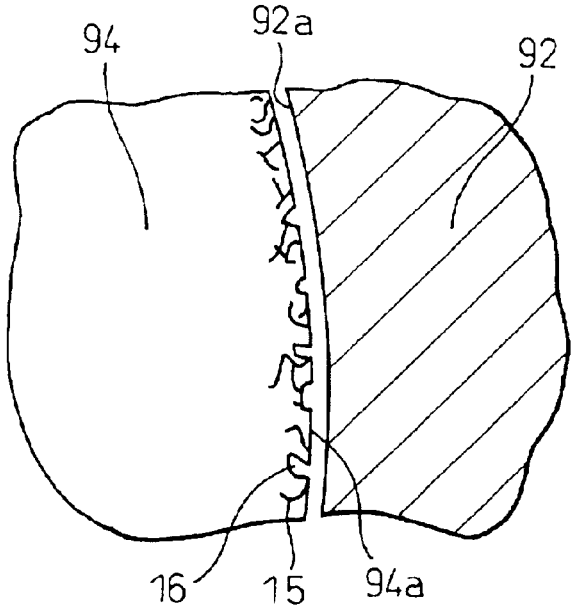
FIG. 6 is a partial sectional view of a sliding part between a shoe and piston of a compressor incorporating the shoe of the comparative example.
Figure 7:
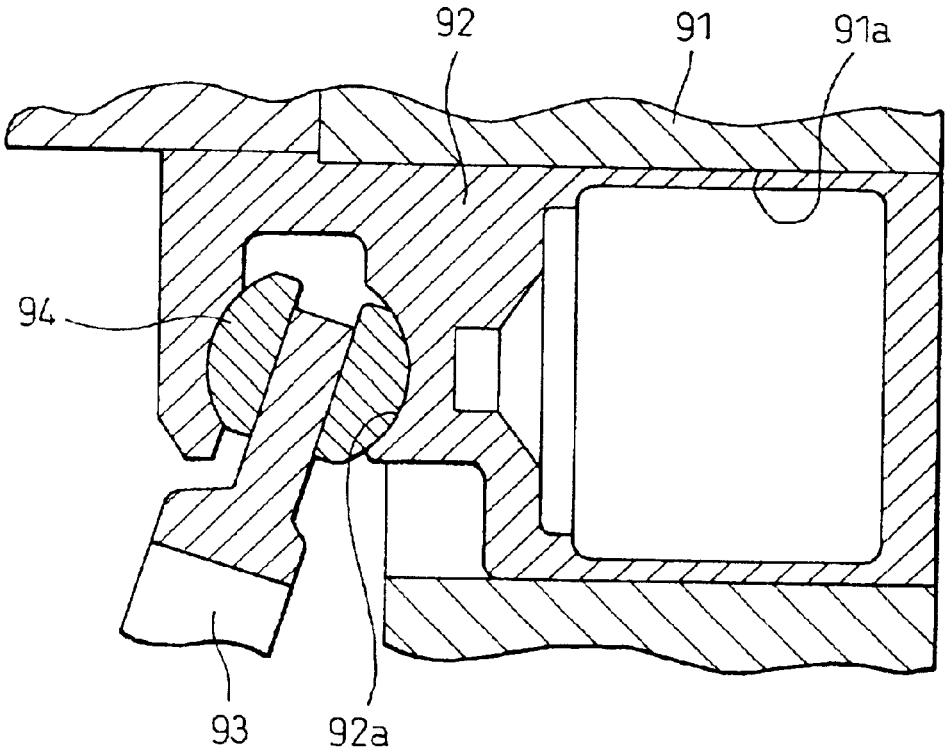
FIG. 7 is a partial sectional view of a compressor incorporating the shoes of Examples 1 to 3 and the comparative example.
Figure 8:
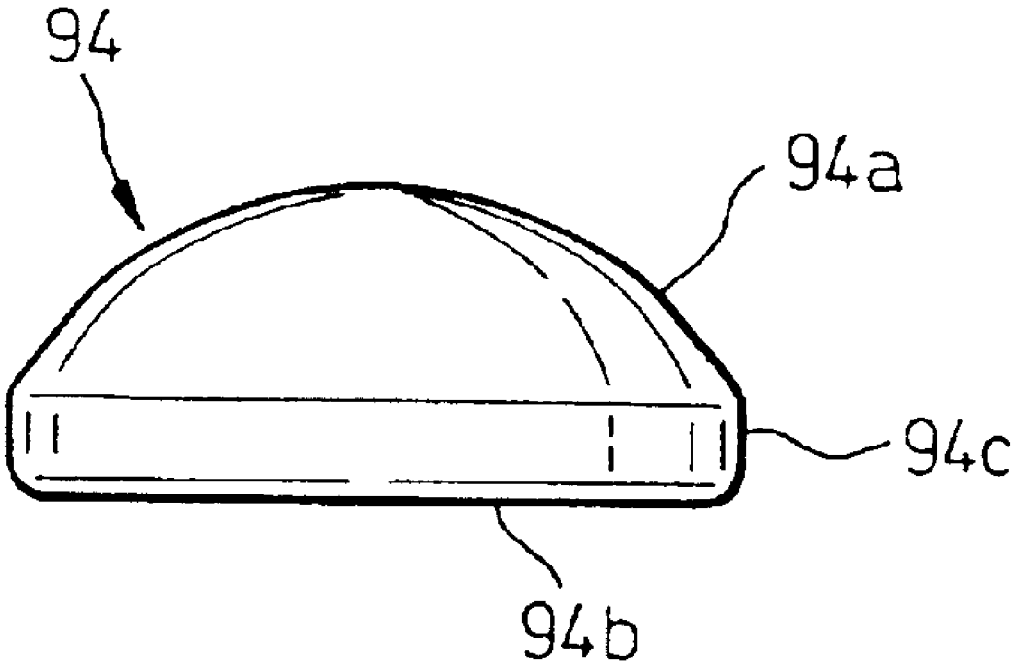
FIG. 8 is a side view of a shoe of Examples 1 to 3 and a comparative example.

That is, in the process of production of the related art, modified gas is blown into the heat treatment furnace so as to replace the air in the heat treatment furnace with modified gas. The quenching process S72 on the material 81 was performed in this atmosphere. Therefore, the quenching process S72 was performed under conditions where the oxygen in the air remained in the atmosphere in a slight amount and under a considerably high temperature, so the oxygen in the atmosphere reacted with the chrome or manganese present near the surface of the material 81 and oxides of chrome or manganese easily formed at the crystal grain boundaries. The oxides of chrome or manganese present on the surface of the shoe 83 are brittle, so as shown in FIG. 6, during operation, microcracks form at the crystal grain boundaries and the metallic texture ends up flaking off due to the sliding action with the spherical seat 92*a*. On the other hand, chrome and manganese are elements added to improve the quenchability. Due to these, greater abrasion resistance and longer fatigue life can be realized. Therefore, chrome and manganese are essential elements.

Therefore, the obtained heat treated shoe 83 was subjected to a sufficient polishing process S74 to remove all of the oxides of chrome or manganese present at the crystal grain boundaries at the surface. As a result, a long time was need for the polishing process S74 and the amount of the polishing agent used increased, so soaring costs of manufacture were induced as a result.

Therefore, the process of production of a compressor shoe of the present invention is provided with a quenching process for quenching a material comprised of chrome and/or manganese steel formed in the shape of a shoe. In the quenching process, a means is applied for preventing oxidation of the chrome and/or manganese.

In the process of production of the present invention, high carbon chrome bearing steel or other steel in which chrome and manganese are added such as the superior quenchability SUJ2 (JIS G4805) is used as the material. In the high carbon chrome bearing steel, the chrome and manganese are added for improving the quenchability. Further, in the present invention, it is possible to use as materials other steel containing chrome or steel containing manganese.

In the process of production of the present invention, in the quenching process, the oxidation of the chrome and/or manganese of the material is prevented, so no oxides of chrome or manganese are formed at the crystal grain boundaries. Therefore, no microcracks form at the crystal grain boundaries, the surface of the shoe does not flake off to form abraded dust during operation of the compressor, and the shoe clearance is not increased. As a result, the compressor maintains sufficient performance over a long period.

Further, in the process of production of the present invention, there is no longer a need to remove the oxides of chrome or manganese by polishing, so the amount polished can be reduced. Therefore, the polishing can be completed in a short time, the amount of the polishing agent used is reduced, and in turn it is possible to realize a reduction of the costs of manufacture.

Therefore, in the process of production of the present invention, it is possible to produce a compressor shoe superior in durability and lower in cost.

In the process of production of the present invention, as the means for preventing oxidation, it is preferable to perform the quenching process in a vacuum. By performing the quenching in a vacuum, it is possible to reliably prevent the chrome and/or manganese added to the steel from being oxidized. Therefore, it is possible to reliably obtain the action and effects of the present invention. Further, according to this process, since a gas for replacing the air is not necessary, the running costs also become lower. The quenching process in vacuum is preferably performed with a high degree of vacuum.

Alternatively, in the process of production of the present invention, as the means for preventing oxidation, it is preferable to perform the quenching process in an atmosphere of inert gas or modified gas. In this case, the oxygen in the air should not be left as in the related art. Further, oxygen should not be contained in the inert gas or modified gas. By sufficiently replacing the air atmosphere with inert gas or modified gas, there is no oxygen present in the atmosphere of the quenching process and therefore again it is possible to reliably prevent oxidation of the chrome and/or manganese. Here, as the inert gas, it is possible to use argon, helium, or another rare gas or nitrogen or another gas poor in reactivity. Further, it is possible to use a mixed gas of these inert gases. On the other hand, as the modified gas, it is possible to use one made from propane etc. Further, to prevent residual oxygen, it is possible to bring the furnace to a vacuum once and then introduce the inert gas or modified gas.

Further, in the process of production of the present invention, as a means for preventing oxidation, it is preferable to form an antioxidation film able to prevent oxidation of chrome and/or manganese on the surface of the material before the quenching process. After forming an antioxidation film on the surface of the material, even if there were oxygen present in the atmosphere at the quenching process, it would be possible to prevent oxidation of the chrome and/or manganese in the material and therefore possible to obtain the action and effects of the present invention. Further, according to this process, the vacuum pump and piping for replacement of the atmosphere etc. become unnecessary, so the capital costs for the quenching process can be lowered.

Here, as the antioxidation film, it is possible to employ a phosphate film. A phosphate film is formed as a dense film on the surface of the material, so is superior in function as an antioxidation film. Further, by forming a phosphate film at a stage prior to forming the shoe shape, it is possible to reduce the press pressure at the press forming process for forming the shoe shape and to improve the dimensional precision of the press forming.

Next, Examples 1 to 3 embodying the present invention will be explained along with a comparative example with reference to the drawings.

EXAMPLE 1

Figure 1:
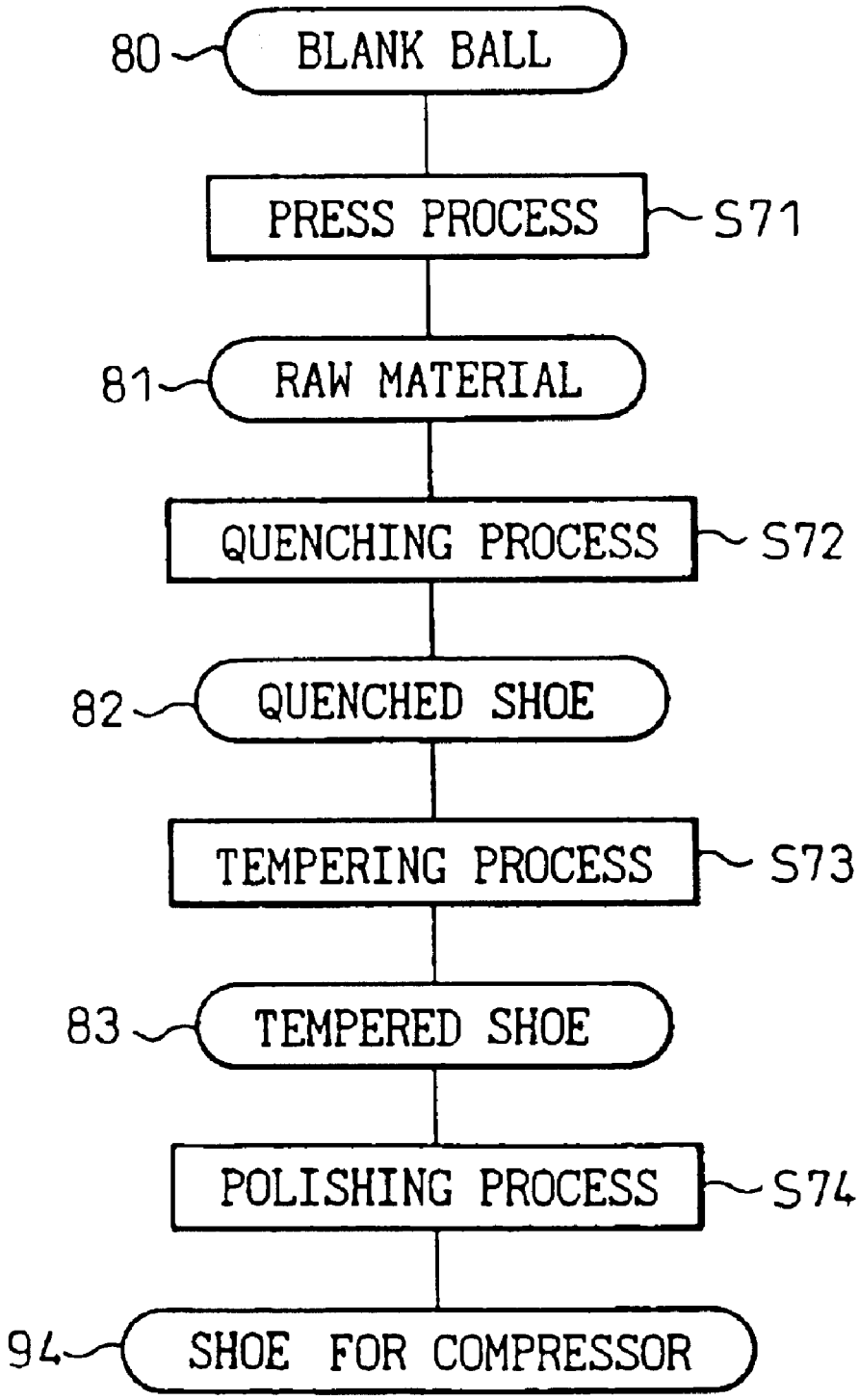
FIG. 1 is a flow chart of Examples 1 to 3 and a comparative example.

In the process of production of the compressor shoe of Example 1, in the same way as the related art, as shown in FIG. 1, a blank ball 80 was subjected to a press forming process S71 to form the material 81. The material 81 was then subjected to a quenching process S72 to obtain a quenched shoe 82. This quenched shoe 82 was subjected to a tempering process S73 to obtain a heat treated shoe 83. The heat treated shoe 83 was then subjected to a polishing process S74 to obtain the shoe 94.

Example 1, however, differs from the process of the related art in the following process. That is, at the quenching process S72, a quenching furnace connected to a vacuum pump was used. The material 81 was placed in this quenching furnace and the vacuum pump operated to lower the pressure in the quenching furnace to about 5 to 10 Pa. The material 81 was held at 500 to 750° C. for 45 to 60 minutes, then held at 800 to 840° C. for 60 to 90 minutes and then rapidly cooled. The material 81 was quenched in this way to obtain the quenched shoe 82.

Further, as the tempering process S73, a tempering furnace able to be replaced in atmosphere with nitrogen was prepared. The quenched shoe 82 was placed in the tempering furnace, the air was replaced with nitrogen, and the pressure of the nitrogen was made about the same as the atmosphere. The shoe was held at 120 to 200° C. for 100 to 150 minutes to temper the quenched shoe 82. A heat treated shoe 83 was obtained in this way.

Finally, as the polishing process S74, the heat treated shoe 83 was polished under the following conditions using a polishing pad. The compressor shoe 94 of Example 1 was obtained in this way.

Abrasive: GC#500 to #1500

Rotational speed: 80 to 90 rpm

Pressure: 300 to 600 g/piece

Polishing time: 10 to 15 minutes (shoes fit into several hundred holes provided in rotating disk)

EXAMPLE 2

In the process of production of the compressor shoe of Example 2, at the quenching process S72, a quenching furnace able to be completely replaced in atmosphere by nitrogen gas was used instead of the quenching furnace connected to a vacuum pump. The rest of the conditions were similar to those of Example 1. The compressor shoe 94 of Example 2 was obtained in this way.

EXAMPLE 3

In the process of production of the compressor shoe of Example 3, the blank ball 80 was dipped in a phosphate film treatment solution, then rinsed to form a phosphate film on the blank ball 80. The rest of the conditions were similar to those of Example 1. The compressor shoe 94 of Example 3 was obtained in this way.

COMPARATIVE EXAMPLE

In the process of production of the compressor shoe of the comparative example, a conventional quenching furnace with an atmosphere able to be replaced by a modified gas was used at the quenching process S72 and the quenching was performed under a modified gas atmosphere. Here, the oxygen in the air remained residually. The rest of the conditions were similar to those of Example 1. The compressor shoe 94 of the comparative example was obtained in this way.

Evaluation of Surface of Metallic Texture

The shoes 94 of Example 1 and the comparative example manufactured in the above way were examined at their surfaces by a scanning electron microscope and analyzed at their surface by an X-ray microanalyzer. Further, the metallic textures of the cross-sections of the shoes 94 were examined and analyzed by a metallurgical microscope and X-ray microanalyzer.

For the analysis of the metallic texture of the surface, each shoe 94 was cut by a cutting machine, then the resultant cut piece was buried in a resin. Next, the cut piece of the shoe 94 buried in the resin was polished to a mirror finish by a polishing machine. Next, the polished surface of the cut piece was analyzed by an X-ray microanalyzer. For examination of the metallic texture of the cross-section, after the analysis of the cross-section by the X-ray analyzer, the mirror polished surface was corroded by a Nytal corrosive solution and then examined by a metallurgical microscope.

Examination and Analysis of Surface

Figure 2:
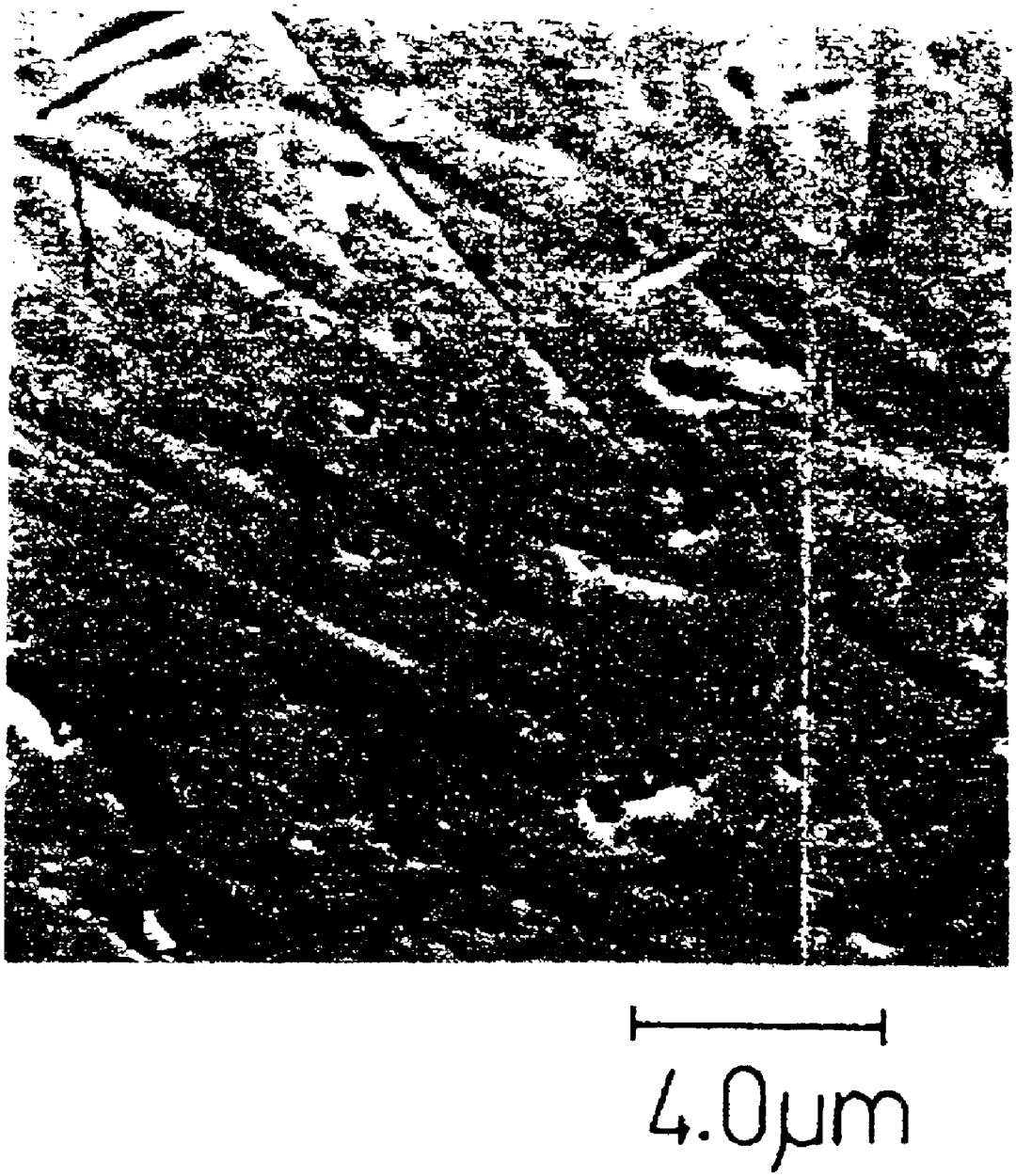
FIG. 2 is a photograph of a cross-section of the surface of the shoe of Example 1 taken by a scanning electron microscope.

With the shoe 94 of Example 1, as shown in FIG. 2, no presence of granular substances at the surface of the shoe 94 could be observed. With the shoes 94 of Example 2 and Example 3 as well, while not shown, in the same way as Example 1, no presence of granular substances could be observed.

Figure 4:
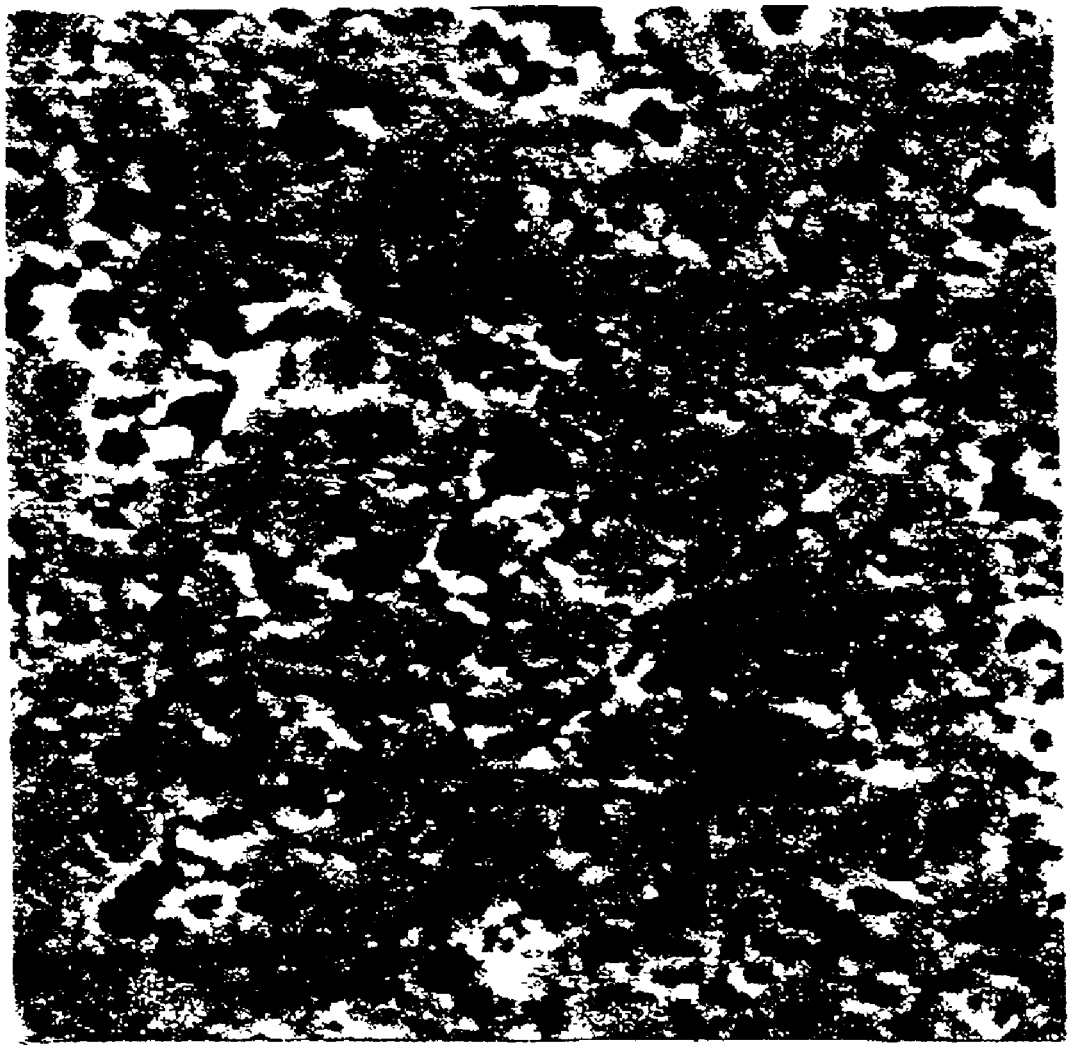
FIG. 4 is a photograph of a cross-section of the surface of the shoe of the comparative example taken by a scanning electron microscope.

As opposed to this, with the shoe 94 of the comparative example, as shown in FIG. 4, granular substances forming dark contrasts were observed at the surface of the shoe 94. The presence of chrome or manganese along with oxygen was observed in the dark contrast portions. Therefore, the granular substances can be considered to be oxides of chrome or manganese.

Examination and Analysis of Cross-Section

Figure 3:
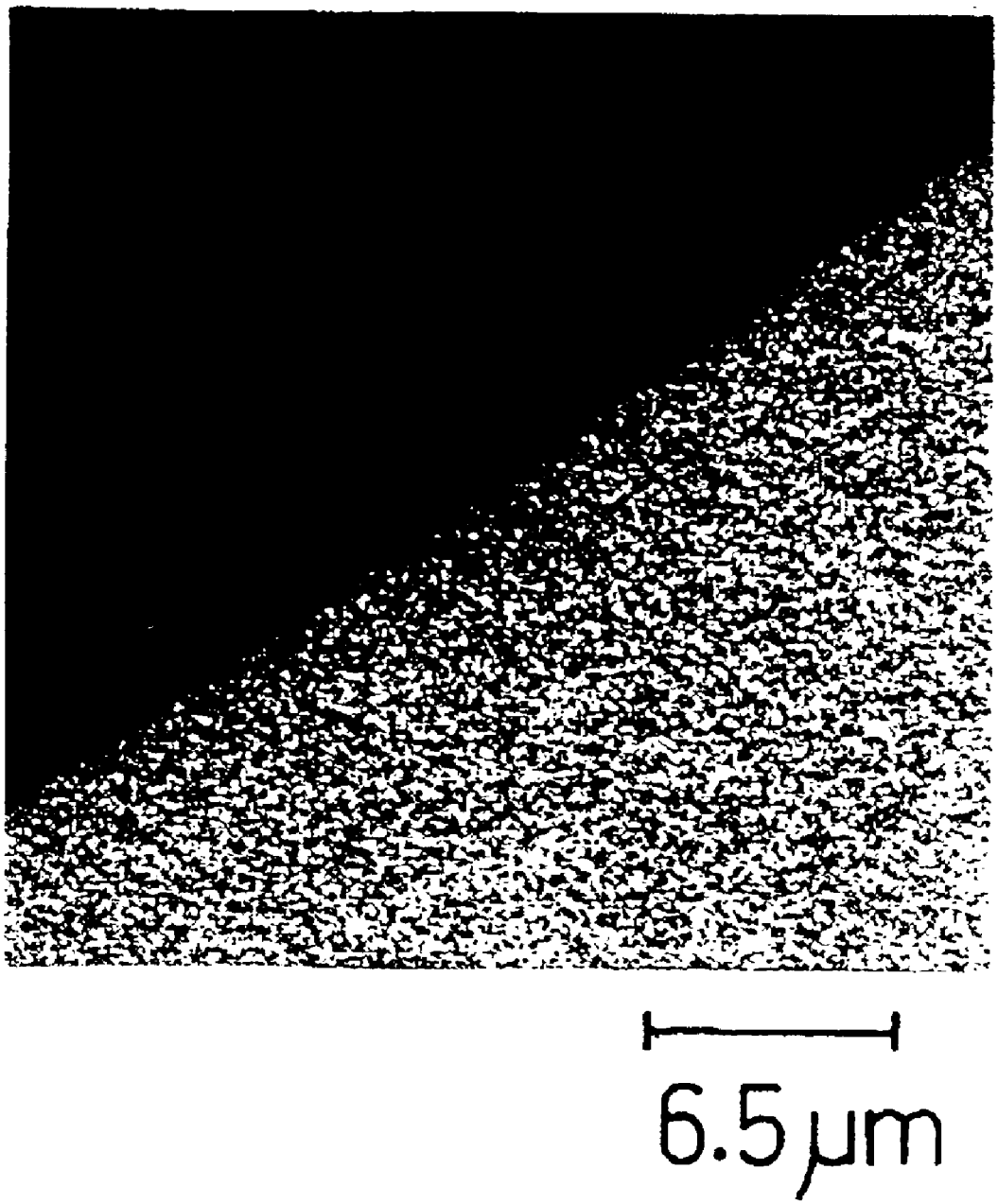
FIG. 3 is a photograph of the texture of a cross-section of the shoe of Example 1 taken by a metallurgical microscope.

With the shoe 94 of Example 1, as shown in FIG. 3, no defects could be observed near the surface. With the shoes 94 of Example 2 and Example 3 as well, while not shown, in the same way as Example 1, the presence of granular substances could not be observed.

Figure 5:
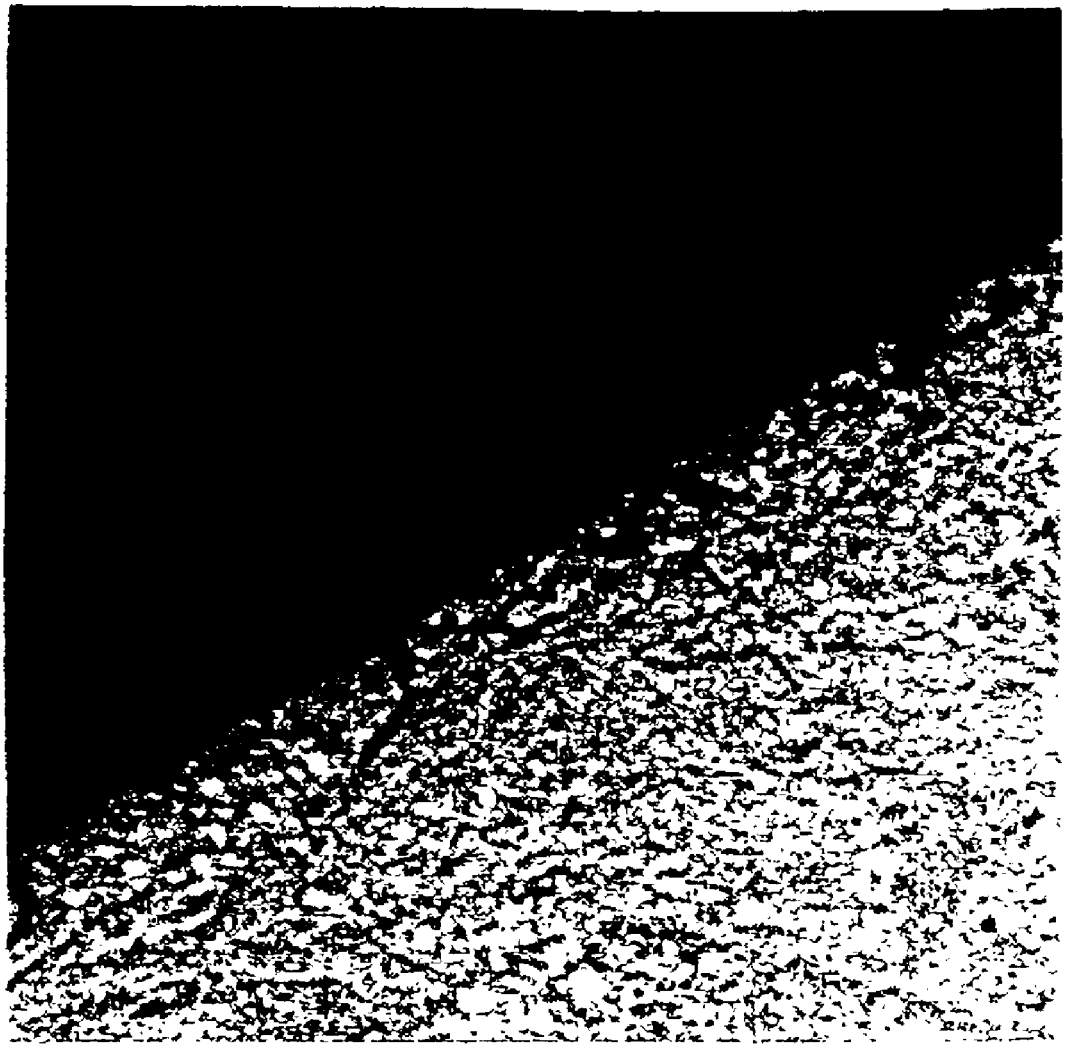
FIG. 5 is a photograph of the texture of a section of the shoe of the comparative example taken by a metallurgical microscope.

As opposed to this, with the shoe 94 of the comparative example, as shown in FIG. 5, a texture corroded along the crystal grain boundaries was observed in the cross-section up to a depth of about 1.5 $\mu$m from the surface. Further, the corroded locations of the texture were found to match with the locations where oxides of chrome or manganese had been present by analysis by an X-ray microanalyzer. From this, it is learned that in the comparative example, the chrome and manganese which had been present up to a depth of about 1.5 $\mu$m from the surface oxidize and are present at the crystal grain boundaries.

From the above results, it is learned that with the shoes 94 of Examples 1 to 3, the chrome and manganese added to the SUJ2 do not oxidize, while with the shoe 94 of the comparative example, the chrome and manganese which had been present near the surface are oxidized.

Therefore, when operating a compressor incorporating the shoe 94 of the comparative example, it is learned that the shoe 94 is subjected to the large frictional force from the spherical seat 92*a* of the piston 92, so as shown in FIG. 6, microcracks 15 easily occur at the crystal grain boundaries at the shoe top surface 94*a* and the metallic texture easily flakes off.

As opposed to this, when operating a compressor incorporating the shoe 94 of Examples 1 to 3, it is learned that the shoe 94 is free of microcracks at the crystal grain boundaries, the surface of the shoe does not flake off to form abraded dust, and the shoe clearance does not increase. As a result, it is learned that the compressor can maintain sufficient performance for a long period.

Further, in the processes of production of the shoe 94 of Examples 1 to 3, since it is not necessary to polish off the oxides of chrome or manganese at the polishing process S74 shown in FIG. 1, it is possible to reduce the polished amount. Therefore, it is possible to shorten the time required for polishing, the amount of the polishing agent used becomes smaller, and in turn it is possible to realize lower costs of manufacture.

Further, in the processes of production of the shoe 94 of Examples 1 and 3, since no gas is required for replacing the air, the running costs also become lower.

Further, in the process of production of the shoe 94 of Example 3, since the press forming process S71 is performed after forming the phosphate film on the blank ball 80, it is possible to reduce the press pressure at the time of press forming and possible to improve the dimensional precision of the material 81.

Therefore, it is learned that according to the processes of production of Examples 1 to 3, it is possible to produce a compressor shoe 94 superior in durability and inexpensive in cost.

Note that it is also possible to combine the above examples. For example, it is possible to quench a shoe formed with an antioxidation film in an atmosphere of an inert gas or modified gas. In this case, no means for evacuating the residual oxygen has to be devised and oxidation can be reliably prevented.

While the invention has been described with reference to specific embodiments chosen for purpose of illustration, it should be apparent that numerous modifications could be made thereto by those skilled in the art without departing from the basic concept and scope of the invention.

The present disclosure relates to subject matter contained in Japanese Patent Application No. 2001-183113, filed on Jun. 18, 2001, the disclosure of which is expressly incorporated herein by reference in its entirety.

What is claimed is:

1. A process of production of a compressor shoe including a process of quenching a material in a quenching furnace comprised of chrome and/or manganese steel and forming a shoe shape, said quenching process comprising a step of preventing oxidation of the chrome and/or manganese, wherein said step is lowering a pressure in the quenching furnace to create a vacuum.

2. A process of production of a compressor shoe including a process of quenching a material in a quenching furnace comprised of chrome and/or manganese steel and forming a shoe shape, said quenching process comprising a step of preventing oxidation of the chrome and/or manganese, wherein said step is replacing an atmosphere of the quenching furnace by an inert gas or modified gas.

3. A process of production of a compressor shoe including a process of quenching a material in a quenching furnace comprised of chrome and/or manganese steel and forming a shoe shape, said quenching process comprising a step of preventing oxidation of the chrome and/or manganese, wherein said step is forming an anti-oxidation film able to prevent oxidation of the chrome and/or manganese on the surface of the material before quenching, and wherein said anti-oxidation film is a phosphate film.

* * * * *